US009019334B2

(12) United States Patent
Ohnishi et al.

(10) Patent No.: US 9,019,334 B2
(45) Date of Patent: Apr. 28, 2015

(54) OPTICAL DEVICE AND IMAGE FORMING APPARATUS HAVING THE OPTICAL DEVICE INCORPORATED THEREIN

(75) Inventors: Masato Ohnishi, Osaka (JP); Kousuke Uchida, Osaka (JP)

(73) Assignee: Kyocera Mita Corporation (JP)

( * ) Notice: Subject to any disclaimer, the term of this patent is extended or adjusted under 35 U.S.C. 154(b) by 873 days.

(21) Appl. No.: 13/038,423

(22) Filed: Mar. 2, 2011

(65) Prior Publication Data

US 2011/0228028 A1 Sep. 22, 2011

(30) Foreign Application Priority Data

Mar. 19, 2010 (JP) ..... 2010-063599

(51) Int. Cl.

| | |
|---|---|
| ***B41J 2/435*** | (2006.01) |
| ***B41J 2/47*** | (2006.01) |
| ***G03G 15/043*** | (2006.01) |
| ***G03G 15/32*** | (2006.01) |
| ***G03G 21/16*** | (2006.01) |

(52) U.S. Cl.

CPC ..... *B41J 2/471* (2013.01); *G03G 15/043* (2013.01); *G03G 15/326* (2013.01); *G03G 2215/0404* (2013.01); *G03G 2221/1678* (2013.01); *G03G 21/1666* (2013.01); *G03G 15/0435* (2013.01)

(58) Field of Classification Search

None

See application file for complete search history.

(56) References Cited

U.S. PATENT DOCUMENTS 6,339,491 B1 * 1/2002 Kondou et al. ..... 359/212.1

FOREIGN PATENT DOCUMENTS

| | | |
|---|---|---|
| JP | 5-80643 | 4/1993 |
| JP | 7-98436 | 4/1995 |
| JP | 2002-287063 | 10/2002 |
| JP | 2003-132456 | 5/2003 |
| JP | 2003-315716 | 11/2003 |
| JP | 2004-125920 | 4/2004 |
| JP | 2004-145181 | 5/2004 |
| JP | 2005-122021 | 5/2005 |
| JP | 2005-168185 | 6/2005 |
| JP | 2006-102423 | 4/2006 |
| JP | 2007-311524 | 11/2007 |

OTHER PUBLICATIONS

English machine translation of JP 2006-102423.*

Japanese Office Action of Jul. 17, 2012.

* cited by examiner

*Primary Examiner* — Uyen Chau N Le

*Assistant Examiner* — John M Bedtelyon

(74) *Attorney, Agent, or Firm* — Gerald E. Hespos; Michael J. Porco; Matthew T. Hespos

(57) ABSTRACT

An optical device is provided with an optical unit for forming an optical path of a laser beam, and a housing defining an internal space for accommodating the optical unit. The housing includes a partition for dividing the internal space into a first space and a second space. The optical unit includes a sensor arranged in the first space to detect the laser beam in the second space, a mirror arranged in the second space to define a direction of the optical path, a drive source arranged in the second space to operate the mirror to adjust the direction of the optical path, a power line for supplying power to the drive source, and a signal line for transmitting an output signal of the sensor. The signal line extends in the first space and the power line extends in the second space.

8 Claims, 11 Drawing Sheets

OPTICAL DEVICE AND IMAGE FORMING APPARATUS HAVING THE OPTICAL DEVICE INCORPORATED THEREIN

BACKGROUND OF THE INVENTION

1. Field of the Invention

The present invention relates to an optical device for emitting a laser beam and an image forming apparatus with the optical device incorporated therein.

2. Description of the Related Art

With development of optical technologies, optical devices for emitting a laser beam are used in various technological fields. Typically, an optical device includes a sensor configured to detect a laser beam for the purpose of detecting operation of the optical device, synchronizing with operation of another arbitrary apparatus used with the optical device or obtaining other desired results.

An image forming apparatus such as a copier, a printer, a facsimile machine or a complex machine provided with these functions employs, as the aforementioned optical device, an exposure device configured to irradiate a laser beam to a circumferential surface of a photoconductive drum to form an electrostatic latent image. In order to form a desired toner image, the exposure device typically includes a polygon mirror configured to form an optical path of the laser beam and a motor configured to rotate the polygon mirror.

A signal line extending from a sensor and a power line for supplying power to the motor are arranged in a housing of the aforementioned exposure device. The following problems are inherent in arrangement of the signal line and the power line in the housing of the exposure device.

The power line near the signal line causes noise in signals transmitted through the signal line. Accordingly, the signal line needs to be sufficiently spaced apart from the power line. Further, the signal line and the power line need to be so arranged as not to interfere with the optical path formed in the housing. Generally, the signal line and the power line are very flexible. Thus, it is more difficult to fix arrangement positions of these lines as compared with other optical elements used in the exposure device.

Due to the aforementioned problems, a conventional optical device including a drive source which requires power supply and a sensor configured to detect a laser beam is likely to have troubles such as signal noise and interception of a laser beam.

SUMMARY OF THE INVENTION

An object of the present invention is to provide an optical device having such a structure as to reduce noise to signals from a sensor and troubles such as interception of a laser beam, and an image forming apparatus with the optical device incorporated therein.

One aspect of the present invention is directed to an optical device for irradiating a laser beam, including an optical unit configured to form an optical path of the laser beam; and a housing defining an internal space for accommodating the optical unit, the housing including a partition configured to divide the internal space into a first space and a second space, wherein the optical unit includes: a sensor arranged in the first space to detect the laser beam, a mirror arranged in the second space to determine a direction of the optical path, a drive source arranged in the second space to operate the mirror to adjust the direction of the optical path, a power line extending in the second space to supply power to the drive source, and a signal line extending in the first space to transmit an output signal of the sensor.

Another aspect of the present invention is directed to an image forming apparatus for forming a toner image, comprising an image bearing member including a surface configured to bear the toner image; and an optical device configured to irradiate a laser beam to the surface of the image bearing member, the optical device including an optical unit configured to form an optical path of the laser beam, and a housing configured to define an internal space for accommodating the optical unit, wherein: the housing includes a partition configured to divide the internal space into a first space and a second space; and the optical unit includes: a sensor arranged in the first space to detect the laser beam, a mirror arranged in the second space to determine a direction of the optical path, a drive source arranged in the second space to operate the mirror to adjust the direction of the optical path, a power line extending in the second space to supply power to the drive source, and a signal line extending in the first space to transmit an output signal of the sensor.

These and other objects, features and advantages of the present invention will become more apparent upon reading the following detailed description along with the accompanying drawings.

DETAILED DESCRIPTION OF THE PREFERRED EMBODIMENTS

Hereinafter, an optical device and an image forming apparatus according to one embodiment are described with reference to the accompanying drawings. It should be noted that directional terms such as "upper", "lower", "left" and "right" used hereinafter are merely for the purpose of clarifying the description and not of the nature to limit principles of the optical device and the image forming apparatus to be disclosed.

Figure 1:
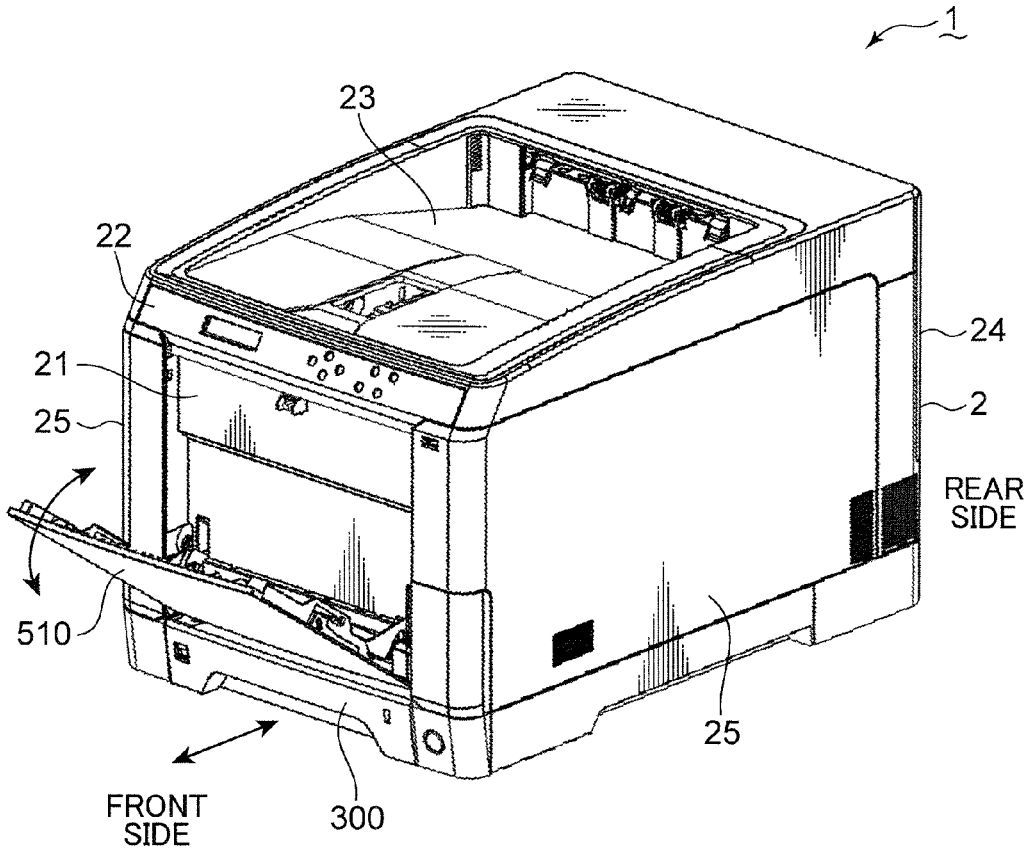
FIG. 1 is a perspective view of an image forming apparatus according to one embodiment.

FIG. 1 is an external perspective view of the image forming apparatus according to the embodiment. It should be noted that the image forming apparatus of FIG. 1 is a printer. Alternatively, the image forming apparatus may be a copier, a facsimile machine, a complex machine provided with these functions or another apparatus configured to form an image on a sheet.

The image forming apparatus 1 includes a rectangular parallelepiped main housing 2, a tray 510 projecting toward a front side of the main housing 2, and a cassette 300 arranged below the tray 510. The main housing 2 accommodates various devices necessary to form an image on a sheet (e.g. elements to be described later constituting an image forming unit). The rotatable tray 510 is mounted on the main housing 2. The tray 510 rotates about a lower edge of the tray 510.

The tray 510 shown in FIG. 1 is at a projecting position where the tray 510 projects from the main housing 2 as described above. A user may place a sheet on the tray 510 at the projecting position. The sheet on the tray 510 is fed toward the image forming unit configured to form an image on the sheet by a feeding assembly to be described later. When the user rotates the tray 510 from the projecting position toward the main housing 2, the tray 510 is accommodated in a recessed area 21 formed on the main housing 2. The cassette 300 is configured to be inserted into and detached from the main housing 2. The cassette 300 is formed with an upward opening. The user may withdraw the cassette 300 forward from the main housing 2 to store sheets in the cassette 300 through the opening. The user may insert the cassette 300 into the main housing 2 after the storage of the desired sheets in the cassette 300.

An operation panel 22 is arranged above the tray 510. The user may operate the operation panel 22 to cause the image forming apparatus 1 to perform desired operation. The operation panel 22 may include, for example, buttons configured to adjust density of a toner image and set other parameters. The image forming apparatus 1 forms a toner image on a sheet in accordance with an input to the operation panel 22 and an image signal (signal including information on an image to be printed) sent from an external apparatus (e.g. personal computer).

The image forming unit forms a toner image on a sheet fed from the tray 510 or the cassette 300. Thereafter, the sheet is discharged onto a discharge tray 23 formed on an upper surface of the main housing 2. The sheet after the image forming process is accumulated in a substantially triangular prism-shaped space formed on the discharge tray 23.

Figure 2:
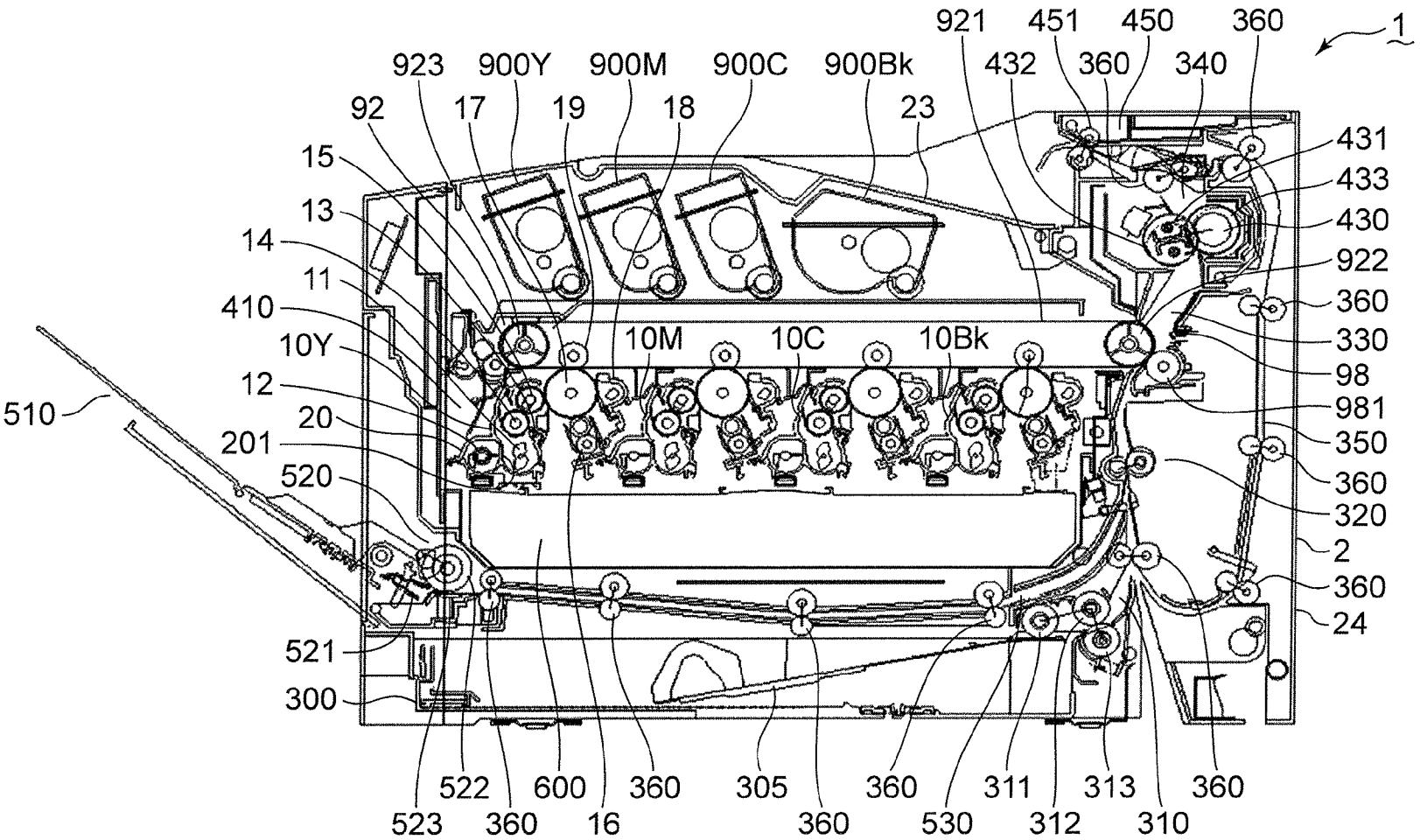
FIG. 2 is a sectional view schematically showing an internal structure of the image forming apparatus shown in FIG. 1.

FIG. 2 schematically shows an internal structure of the image forming apparatus 1. The image forming apparatus 1 is further described with reference to FIGS. 1 and 2.

A sheet is conveyed from the tray 510 or the cassette 300 to an image forming unit 410 configured to form a toner image on the sheet and a fixing unit 430 configured to fix the toner image to the sheet which is guided along a conveyance path formed in the main housing 2. Thereafter, the sheet is discharged onto the discharge tray 23 via a discharger 450.

The conveyance path includes a first feed path 530 extending toward a rear wall 24 of the main housing 2. A feeding assembly 520 configured to feed a sheet to the image forming unit 410 is arranged at an upstream end of the first feed path 530. The feeding assembly 520 pulls a sheet on the tray 510 into the main housing 2. The conveyance path further includes a second feed path 310 extending upward from a downstream end (right end in FIG. 2) of the cassette 300 located below the first feed path 530. The first and second feed paths 530, 310 join before paired registration rollers 320 configured to feed a sheet to the image forming unit 410 in synchronization with the image forming process of the image forming unit 410.

The conveyance path further includes a main path 330 configured to guide a sheet from the paired registration rollers 320 to the fixing unit 430 and a discharge path 340 configured to guide the sheet from the fixing unit 430 to the discharger 450. The image forming unit 410 forms a toner image on the sheet moving along the main path 330. The fixing unit 430 fixes the toner image to the sheet thereafter. When the user causes the image forming apparatus 1 to perform simplex printing, the discharger 450 discharges a sheet fed from the fixing unit 430 to the discharge path 340 to outside of the main housing 2. The discharged sheet is placed on the discharge tray 23.

When the user causes the image forming apparatus 1 to perform duplex printing, the discharger 450 performs a switch-back operation for pulling the sheet back into the main housing 2 after feeding the sheet, which is fed from the fixing unit 430 to the discharge path 340, to the outside of the main housing 2 by a predetermined length. The conveyance path further includes a return path 350 configured to guide the sheet pulled back by the discharger 450. The return path 350 extends from the discharger 450 toward the rear wall 24 of the main housing 2, and then extends downward. Thereafter, the return path 350 extends toward the second feed path 310 to join the second feed path 310.

Paired conveyor rollers 360 are arranged in position of the first feed path 530, the second feed path 310, the main path 330, the discharge path 340 and the return path 350. The paired conveyor rollers 360 convey a sheet guided by these conveyance paths 530, 310, 330, 340 and 350.

As described above, the sheet placed on the tray 510 is fed to the first feed path 530 by the feeding assembly 520. The feeding assembly 520 includes a lift plate 521 configured to push up a leading edge of the sheet on the tray 510 inclined downwardly toward the main housing 2, a feed roller 522 configured to contact the leading edge of the sheet pushed up by the lift plate 520 and a separation pad 523 arranged below the feed roller 522. When the feed roller 522 rotates, the sheet passes between the feed roller 522 and the separation pad 523 to be fed into the first feed path 530. The separation pad 523 applies a frictional force to the sheet passing between the feed roller 522 and the separation pad 523. Accordingly, when the feed roller 522 tries to feed several sheets into the first feed path 530, the separation pad 523 applies the frictional force acting in a direction opposite to a sheet conveying direction to the sheets other than the uppermost one (sheet directly in contact with the feed roller 522) to hinder the conveyance into the first feed path 530. As a result, the sheets are fed into the first feed path 530 one by one.

The cassette 300 used as the other sheet feeding source includes a lift plate 305 configured to support sheets stored in the cassette 300. The lift plate 305 is so inclined as to push leading edges of the sheets in the cassette 300 upward (toward the opening of the cassette 300 and/or a pickup roller 311). The pickup roller 311 is arranged above a downstream end of the lift plate 305. The pickup roller 311 comes into contact with the leading edge of the sheet pushed up by the lift plate 305. As a result, the sheet is fed to a downstream side from the cassette 300 when the pickup roller 311 rotates.

A feed roller 312 and a retard roller 313 located below the feed roller 312 are arranged after the pickup roller 311. The pickup roller 311 feeds the sheet between the feed roller 312 and the retard roller 313. The feed roller 312 rotates to feed the sheet to a further downstream side. Rotation of the retard roller 313 is controlled by a torque limiter. When the pickup roller 311 feeds several sheets between the feed roller 312 and the retard roller 313, the torque limiter operates to disable the rotation of the retard roller 313. As a result, the retard roller 313 applies a frictional force against conveyance of the sheets other than the uppermost one (sheet directly in contact with the feed roller 312). When the pickup roller 311 feeds one sheet between the feed roller 312 and the retard roller 313, the torque limiter does not operate and so the retard roller 313 rotates as the sheet is conveyed. As a result, the sheets are fed into the second feed path 310 one by one.

The sheet fed into the second feed path 310 is conveyed toward the paired registration rollers 320 by the paired conveyor rollers 360 provided in the second feed path 310. The aforementioned return path 350 joins the second feed path 310 before the paired conveyor rollers 360 of the second feed path 310. Accordingly, the paired conveyor rollers 360 of the second feed path 310 similarly feed a sheet supplied to the second feed path 310 via the return path 350 to the paired registration rollers 320. The first and second feed paths 530, 310 join before the paired registration rollers 320. Thus, the paired registration rollers 320 supply the sheet conveyed via the first feed path 530 or the second feed path 310 to the image forming unit 410.

The image forming unit 410 includes a yellow (Y) toner container 900Y, a magenta (M) toner container 900M, a cyan (C) toner container 900C and a black (Bk) toner container 900Bk. Developing devices 10Y, 10M, 10C and 10Bk corresponding to Y, M, C and Bk are arranged below these containers, respectively. The image forming unit 410 forms an image on a sheet using toner contained in these toner containers 900Y, 900M, 900C and 900Bk, respectively.

The image forming unit 410 includes photoconductive drums 17 (photoconductors on which latent images are formed by an electrophotographic method) used as image bearing members configured to bear toner images. The circumferential surfaces of the photoconductive drums 17 are used as surfaces configured to bear the toner images. Photoconductive drums using an amorphous silicon (a-Si) containing material are used as the photoconductive drums 17. Yellow toner, magenta toner, cyan toner and black toner are supplied from the toner containers 900Y, 900M, 900C and 900Bk to the photoconductive drums 17, respectively.

A charger 16, the developing device 10 (10Y, 10M, 10C or 10Bk), a transfer unit 19 and a cleaner 18 are arranged around each photoconductive drum 17. The charger 16 uniformly charges the surface of the photoconductive drum 17. An exposure device 600 exposes the charged surface of the photoconductive drum 17 to light to form an electrostatic latent image. The exposure device 600 emits laser light to the charged surface of the photoconductive drum 17, for example, based on an image signal (signal including image information) from an external apparatus. In this embodiment, the exposure device 600 is exemplified as an optical device.

The developing devices 10Y, 10M, 10C and 10Bk supply toner from the toner containers 900Y, 900M, 900C and 900Bk to form toner images in conformity with the electrostatic latent images formed on the corresponding photoconductive drums 17, respectively. The transfer units 19 and the photoconductive drums 17 sandwich an intermediate transfer belt 921 to form nip portions. The transfer units 19 primarily transfer the toner images on the photoconductive drums 17 to the intermediate transfer belt 921. The cleaners 18 clean the circumferential surfaces of the photoconductive drums 17 after the transfer of the toner images.

Each of the developing devices 10Y, 10M, 10C and 10Bk includes a developer housing 20. Two-component developer composed of magnetic carrier and toner is contained in the developer housing 20. Agitating rollers 11, 12 are arranged near a bottom of the developer housing 20. The agitating rollers 11, 12 parallel to each other rotate in the developer housing 20.

A circulatory path for the developer is formed in an inner bottom surface of the developer housing 20. The agitating rollers 11, 12 are arranged in the circulatory path. The developer housing 20 includes a partition wall 201 upright between the agitating rollers 11 and 12. The partition wall 201 standing from the bottom of the developer housing 20 partially partitions the circulatory path, so that the circulatory path is formed around the partition wall 201. The two-component developer is agitated and conveyed by the agitating rollers 11, 12.

While the two-component developer is circulated in the developer housing 20 and agitated in the circulatory path by the agitating rollers 11, 12, the toner is charged. The two-component developer on the agitating roller 11 is attracted to an upper magnetic roller 14. The attracted two-component developer forms a magnetic brush (not shown) on the magnetic roller 14. A doctor blade 13 restricts thickness of the magnetic brush layer. A toner layer on a developing roller 15 is formed by a potential difference between the magnetic roller 14 and the developing roller 15. The electrostatic latent image on the photoconductive drum 17 is developed by the toner layer.

The exposure device 600 includes a light source configured to emit a laser beam, a polygon mirror used as a mirror configured to determine a direction of an optical path of the laser beam from the light source, an optical unit with optical elements such as a group of other mirrors configured to form the optical path of the laser beam together with the polygon mirror, and a housing configured to define an internal space for accommodating the optical unit. The exposure device 600 emits light based on an image signal to the circumferential surface of the corresponding photoconductive drum 17 of the image forming unit 410 to form an electrostatic latent image.

An intermediate transfer unit 92 includes the intermediate transfer belt 921, a drive roller 922 and an idler 923. Toner images from several photoconductive drums 17 are superimposed on each other on the intermediate transfer belt 921 (primary transfer). The superimposed toner images are secondarily transferred to a sheet supplied from the cassette 300 or the tray 510 in a secondary transfer unit 98. The drive roller 922 and the idler 923 which rotate the intermediate transfer belt 921 are rotatably supported on the main housing 2.

The sheet fed from the paired registration rollers 320 is conveyed between the intermediate transfer belt 921 and a transfer roller 981 used in the secondary transfer unit 98. Thereafter, the sheet bearing the toner image transferred from the secondary transfer unit 98 is then fed to the fixing unit 430.

The fixing unit 430 includes a heating roller 432 with a built-in heater 431 and a pressure roller 433 pressed into contact with the heating roller 432. The sheet fed from the secondary transfer unit 98 is then conveyed between the heating roller 432 and the pressure roller 433. The toner on the sheet receives thermal energy from the heating roller 432 to melt and pressure from the pressure roller 433. As a result, the toner image is fixed to the sheet. The fixing unit 430 feeds the sheet to the discharger 450 via the discharge path 340 after the fixation of the toner to the sheet.

The discharger 450 includes paired discharge rollers 451. The paired discharge rollers 451 configured to rotate bi-directionally perform the aforementioned switch-back operation.

Figure 3:
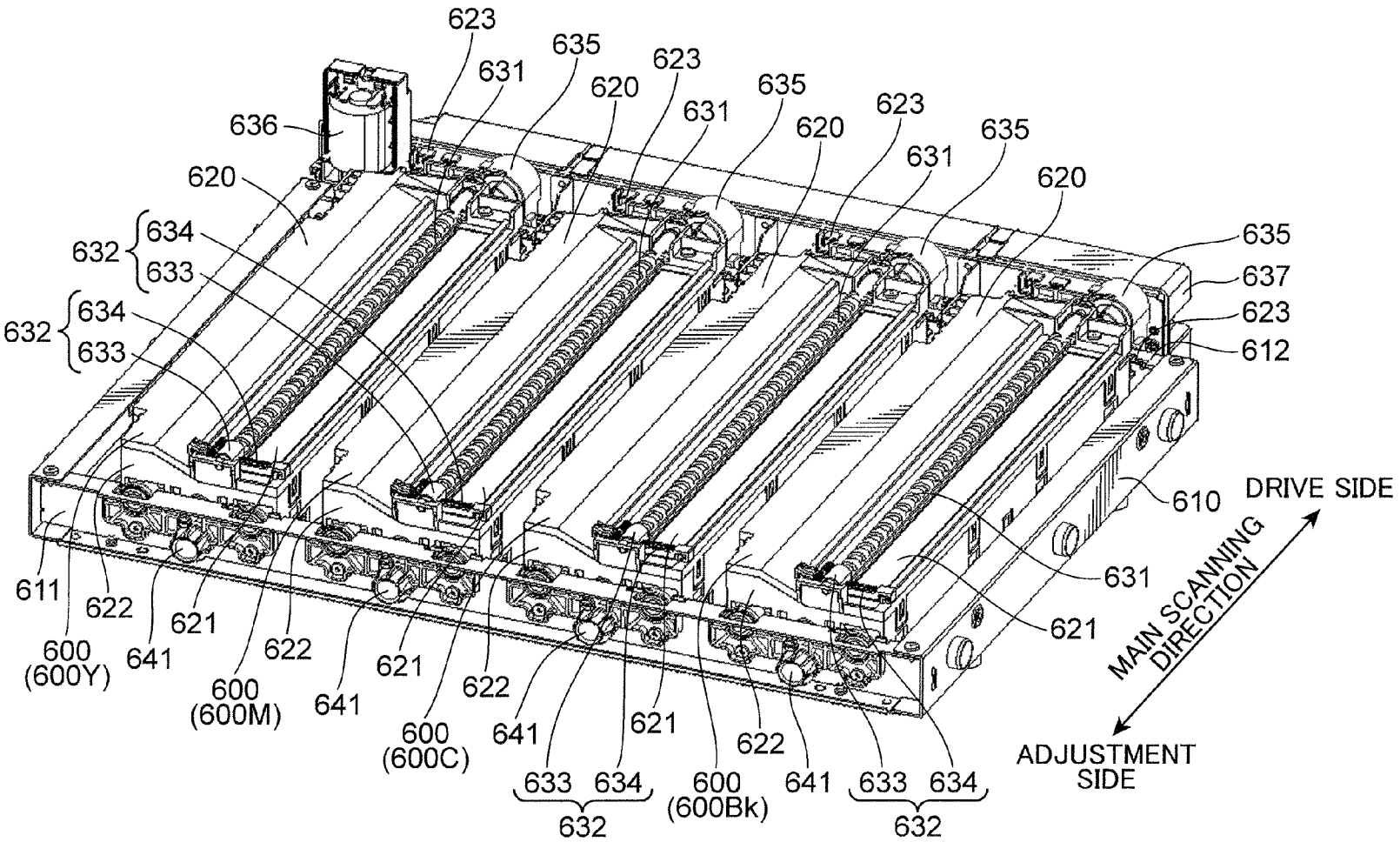
FIG. 3 is a perspective view of four exposure devices incorporated in the image forming apparatus shown in FIG. 1.

FIG. 3 is a perspective view of the exposure devices 600 and a frame 610 configured to support the exposure devices 600. The exposure devices 600 and the frame 610 are described with reference to FIGS. 1 to 3.

The frame 610 having a substantially rectangular contour is used as a supporting body to support the four exposure devices 600. The frame 610 is mounted on an inner surface of the main housing 2 of the image forming apparatus 1. The leftmost exposure device 600Y in FIG. 3 emits a laser beam to the photoconductive drum 17 configured to form a toner image using the yellow toner. The exposure device 600M to the right of the exposure device 600Y emits a laser beam to the photoconductive drum 17 configured to form a toner image using the magenta toner. The exposure device 600C to the right of the exposure device 600M emits a laser beam to the photoconductive drum 17 configured to form a toner image using the cyan toner. The rightmost exposure device 600Bk in FIG. 3 emits a laser beam to the photoconductive drum 17 configured to form a toner image using the black toner.

Each exposure device 600 includes a substantially rectangular parallelepipedic housing 620. The light source configured to generate a laser beam and the optical unit configured to form an optical path of the laser beam emitted from the light source to the photoconductive drum 17 both are accommodated in the housing 620.

The housing 620 includes a substantially rectangular window 621 made of dust-proof glass. The window 621 along a right edge of an upper surface of the housing 620 extends in a main scanning direction of the exposure device 600. A laser beam from the light source arranged in the housing 620 passes through the window 621 and irradiates the circumferential surface of the photoconductive drum 17.

The exposure device 600 includes a screw shaft 631 extending along a left edge of the window 621 and a cleaning portion 632 connected to the screw shaft 631. The cleaning portion 632 includes a ring member 633 mounted on the screw shaft 631 and a wiper 634 extending from the ring member 633 and held in contact with the window 621. The ring member 633 reciprocates in the main scanning direction as the screw shaft 631 rotates. Thus, the window 621 is properly cleaned by the wiper 634.

The frame 610 includes a first support member 611 configured to support the four exposure devices 600, which are sequentially arranged, and a second support member 612 arranged at an opposite side to the first support member 611. The second support member 612 extends substantially in parallel with the first support member 611. The housing 620 includes a first wall 622 along the first support member 611 and a second wall 623 located at an opposite side to the first wall 622. The second support member 612 is configured to extend along the second wall 623. The first support member 611 is formed with an adjustment hole 641 for adjusting an angle of an optical element in the housing 620. The user may insert a dedicated tool into the adjustment hole 641 to change the angle of the optical element. Thus, a side where the first support member 611 is arranged is called an adjustment side. A drive housing 637 configured to partially accommodate drive mechanisms 635 configured to drive the screw shafts 631 is mounted on an outer surface of the second support member 612. The drive mechanisms 635 configured to drive the screw shafts 631 partially appear between the drive housing 637 and the second wall 623. Thus, a side where the second support member 612 is arranged is called a drive side. A drive source (motor) 636 configured to drive the drive mechanisms 635, respectively, is mounted at a corner of the frame 610.

Figure 4:
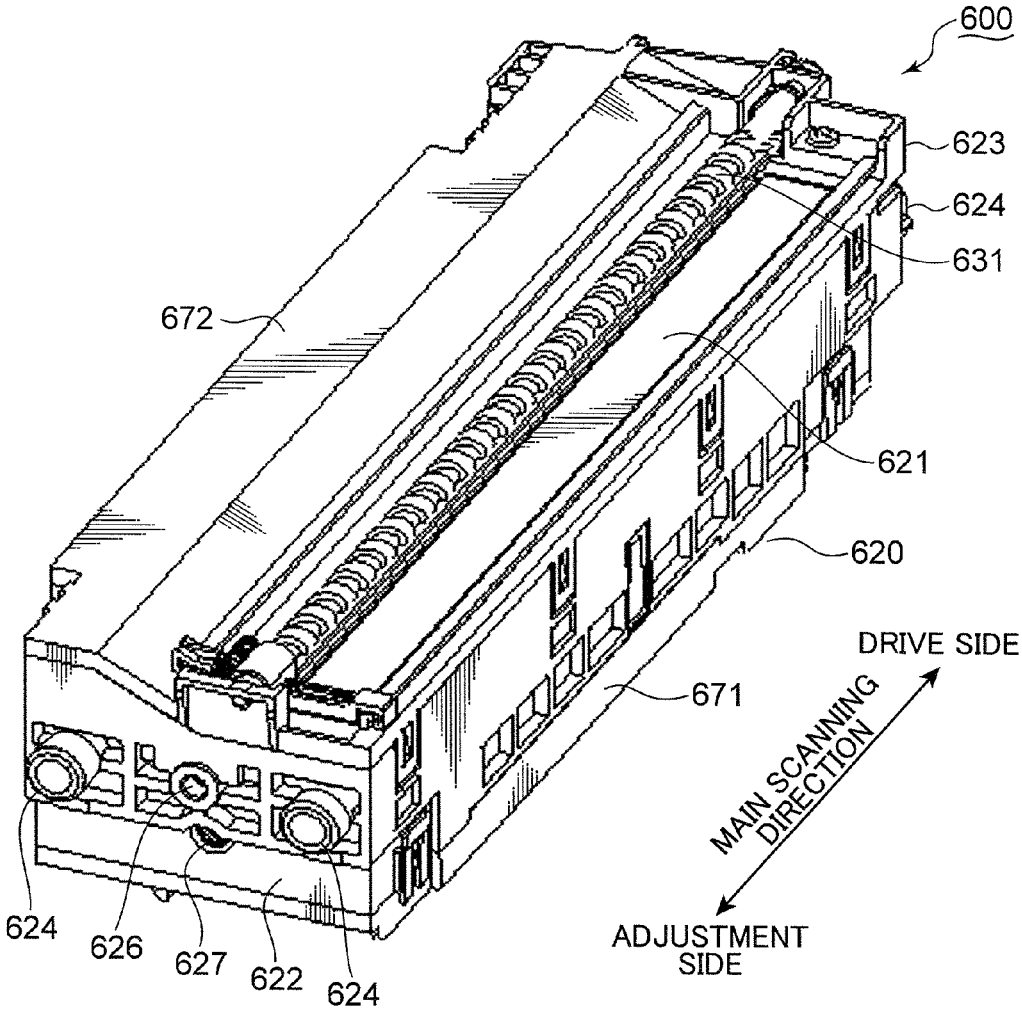
FIG. 4 is a perspective view of one of the four exposure devices shown in FIG. 3.

FIG. 4 is an external perspective view of the exposure device 600. The exposure device 600 is described with reference to FIGS. 3 and 4.

The housing 620 of the exposure device 600 includes a container 671 configured to define an internal space for accommodating the optical unit which forms an optical path of a laser beam, and a lid 672 configured to close an opening formed in an upper part of the container 671. The lid 672 forms an upper surface of the exposure device 600. The container 671 forms the other outer surfaces of the exposure device 600.

All of the aforementioned screw shaft 631, the cleaning portion 632 mounted on the screw shaft 631 and the transmissive window 621 for a laser beam emitted from the optical unit in the housing 620 are connected to the lid 672.

The container 671 includes the first wall 622 extending along the first support member 611 of the frame 610 and the second wall 623 extending along the second support member 612. Each of the first and second walls 622, 623 includes projecting portions 624 supported on the corresponding one of the first and second support members 611, 612. As a result of engaging the projecting portions 624 with the first and second support members 611, 612, the housing 620 is supported on the frame 610. A mount hole 626, into which a fixing member (e.g. screw) for connecting the housing 620 to the first support member 611 is screwed, is formed between the paired projecting portions 624 formed on the first wall 622. A communication hole 627 in communication with the internal space of the housing 620 is formed below the mount hole 626. The user may insert a tip of the tool into the housing 620 through the adjustment hole 641 and the communication hole 627 as described above to adjust the angle of the optical element in the housing 620.

Figure 5:
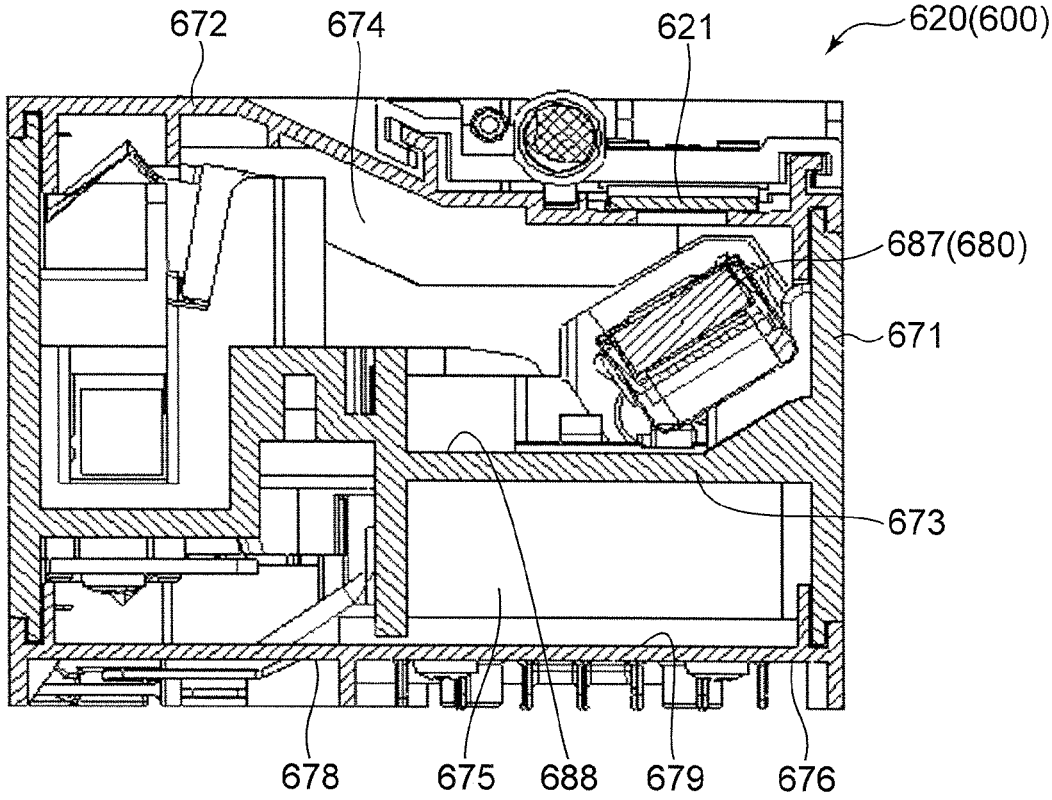
FIG. 5 is a sectional view of a housing of the exposure device shown in FIG. 4.

FIG. 5 is a sectional view of the housing 620 in a direction orthogonal to the main scanning direction. The housing 620 is described with reference to FIGS. 4 and 5.

The container 671 of the housing 620 includes a partition 673. The partition 673 configured to divide the internal space of the container 671 into upper and lower spaces is arbitrarily formed with an opening (e.g. for forming an optical path of a laser beam) if necessary. In this embodiment, an inner space formed above the partition 673 is exemplified as a first space 674. A space formed below the partition 673 is exemplified as a second space 675. An upper opening of the first space 674 is closed by the lid 672 as described above. The container 671 includes a supporting plate 676 which closes the second space 675 and forms an outer surface of the housing 620. In this embodiment, a lower surface of the supporting plate 676 forming the outer surface of the housing 620 is exemplified as a first surface 678. An upper surface (surface opposite to the first surface 678) of the supporting plate 676 defining the second space 675 is exemplified as a second surface 679. Further, an upper surface of the partition 673 defining the first space 674 is exemplified as a third surface 688.

Figure 6:
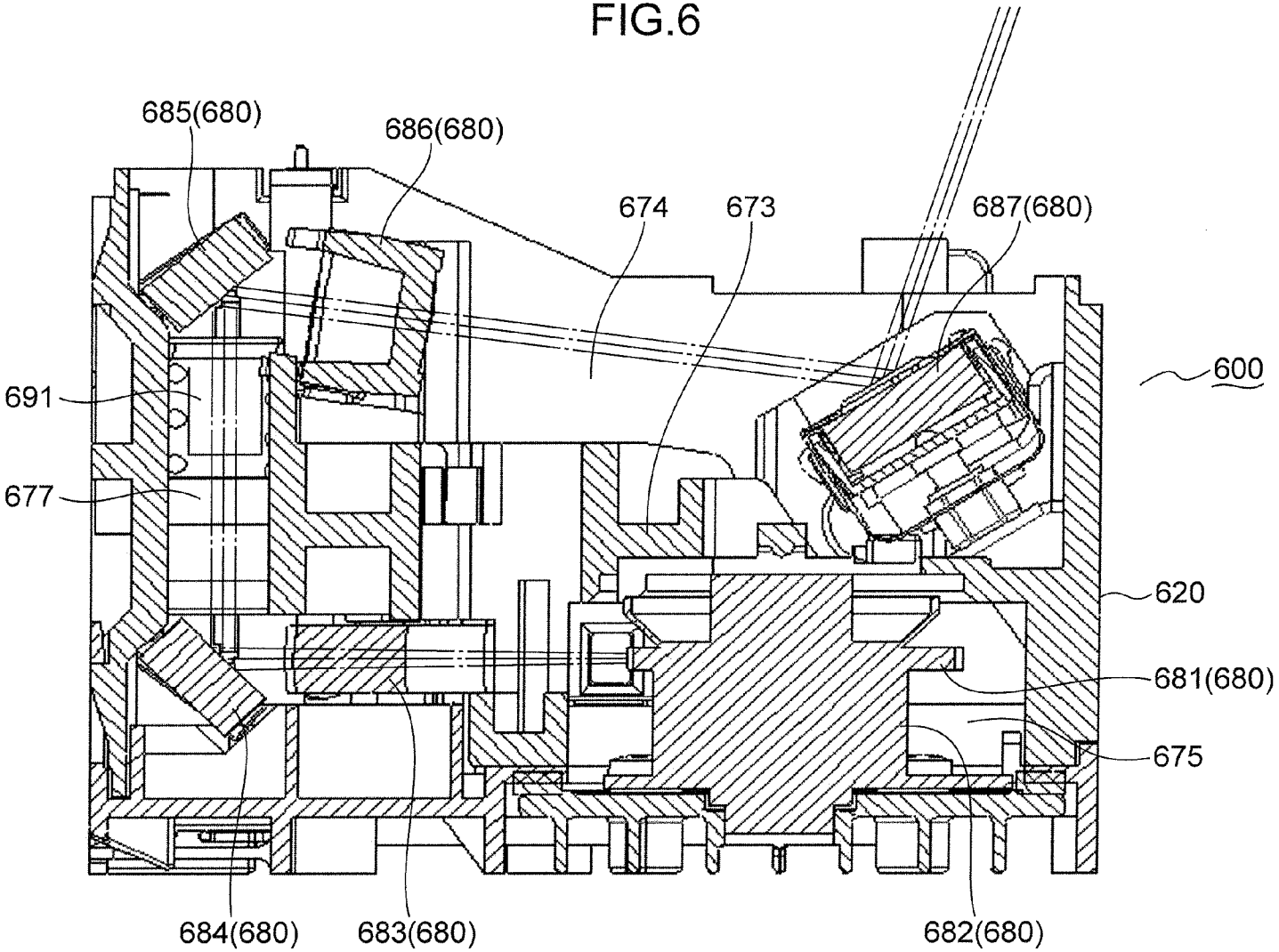
FIG. 6 is a sectional view schematically showing an internal structure of the exposure device shown in FIG. 4.

FIG. 6 is a sectional view of the exposure device 600 schematically showing the optical unit arranged in the housing 20. The optical unit is described with reference to FIGS. 2, 3, 5 and 6.

The optical unit 680 includes a light source (not shown) configured to generate a laser beam, a polygon mirror 681 which receives the laser beam from the light source and is used as a mirror for determining a direction of the laser beam, and a motor 682 which rotates the polygon mirror 681 about a vertical axis passing through a center of the polygon mirror 681 and is used as a drive source for adjusting the direction of the optical path extending from the polygon mirror 681. The motor 682 rotates the polygon mirror 681 at a specific angular speed in accordance with an image signal (signal including information on an image to be printed) sent from an external apparatus (e.g. personal computer). The polygon mirror 681 and the motor 682 are arranged in the second space 675.

A first fθ lens 683 configured to adjust an optical path angle of the laser beam from the polygon mirror 681 and a first mirror 684 configured to reflect the laser beam from the first fθ lens 683 upward are further arranged in the second space 675. The partition 673 is formed with an opening 677 which allows formation of the optical path of the laser beam reflected by the first mirror 684. Thus, the laser beam reaches the first space 674 formed above the second space 675.

A second mirror 685 configured to substantially horizontally reflect the laser beam from the first mirror 684 and a second fθ lens 686 configured to adjust an angle of the optical path of the laser beam reflected by the second lens 685 are arranged in the first space 674. The laser beam after passage through the second fθ lens 686 is reflected by a third mirror 687 arranged in the first space 674 and emerges out of the housing 620. As described in the context of FIG. 3, the laser beam reflected by the third mirror 687 passes through the window 621 (see FIG. 5) and reaches the circumferential surface of the photoconductive drum 17 (see FIG. 2). An angle of the third mirror 687 is adjusted by the dedicated tool inserted through the adjustment hole 641 as described above. As shown in FIG. 5, the third mirror 687 is located below the window 621.

Figure 7:
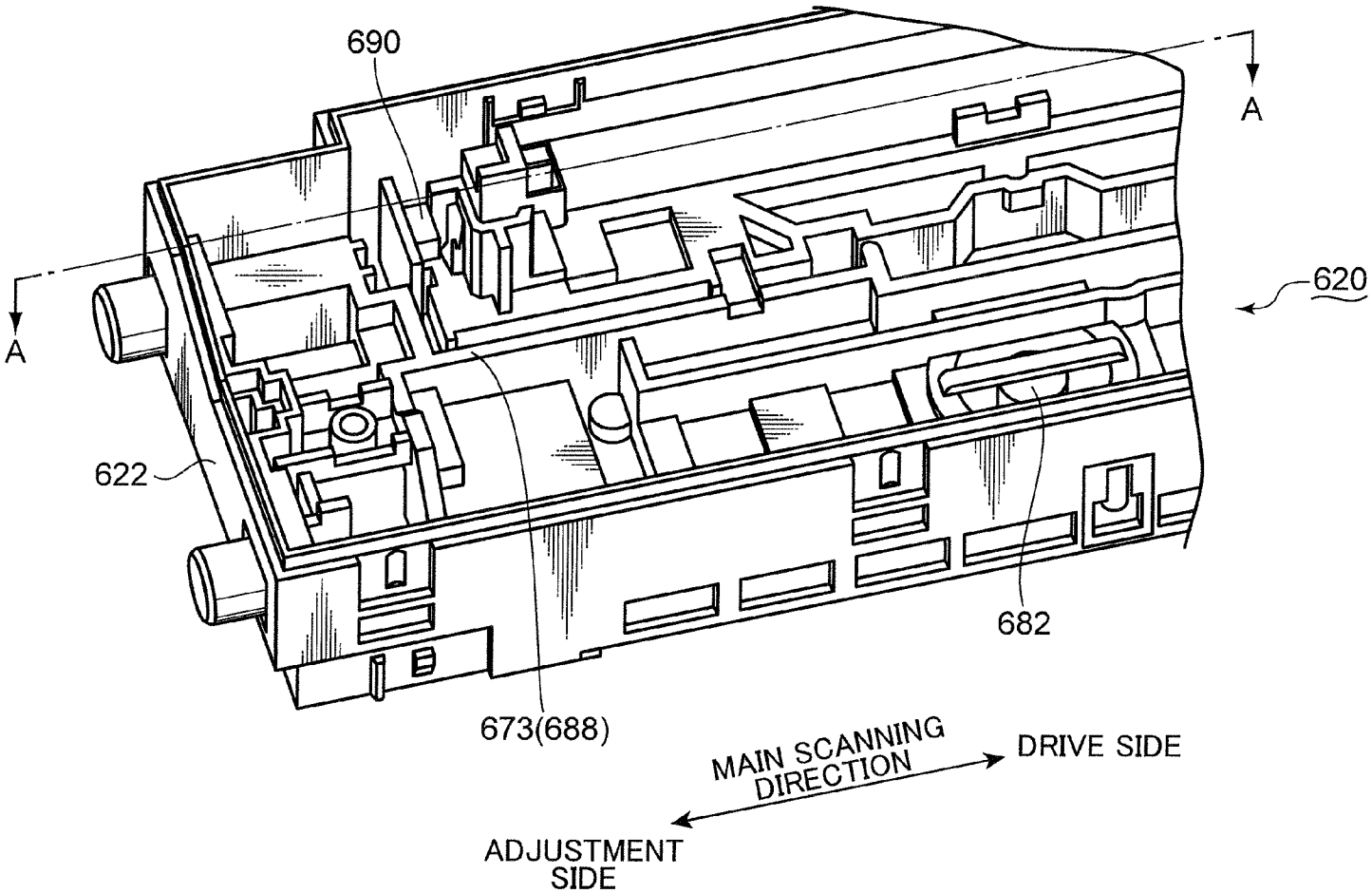
FIG. 7 is a perspective view of an interior of the housing to show a sensor arranged in a first space of the exposure device shown in FIG. 4.

FIG. 7 is a partial perspective view of the housing 620 without the lid 672. The housing 620 is further described with reference to FIGS. 2, 4 to 7.

As shown in FIG. 7, the partition 673 configured to define the internal space of the housing 620 has a relatively complicated shape. Accordingly, the partition 673 and the peripheral wall of the housing 620 including the first and second walls 622, 623 are preferably integrally resin-molded. A sensor 690 configured to detect the laser beam entering the first space 674 from the second space 675 is arranged in the first space 674. The sensor 690 is fixed to the third surface 688 of the partition 673. The sensor 690 is used for detecting a writing timing of an electrostatic latent image to be formed on the circumferential surface of the photoconductive drum 17. FIG. 7 shows the motor 682 configured to rotate the polygon mirror 681 through the opening formed in the partition 673.

Figure 8:
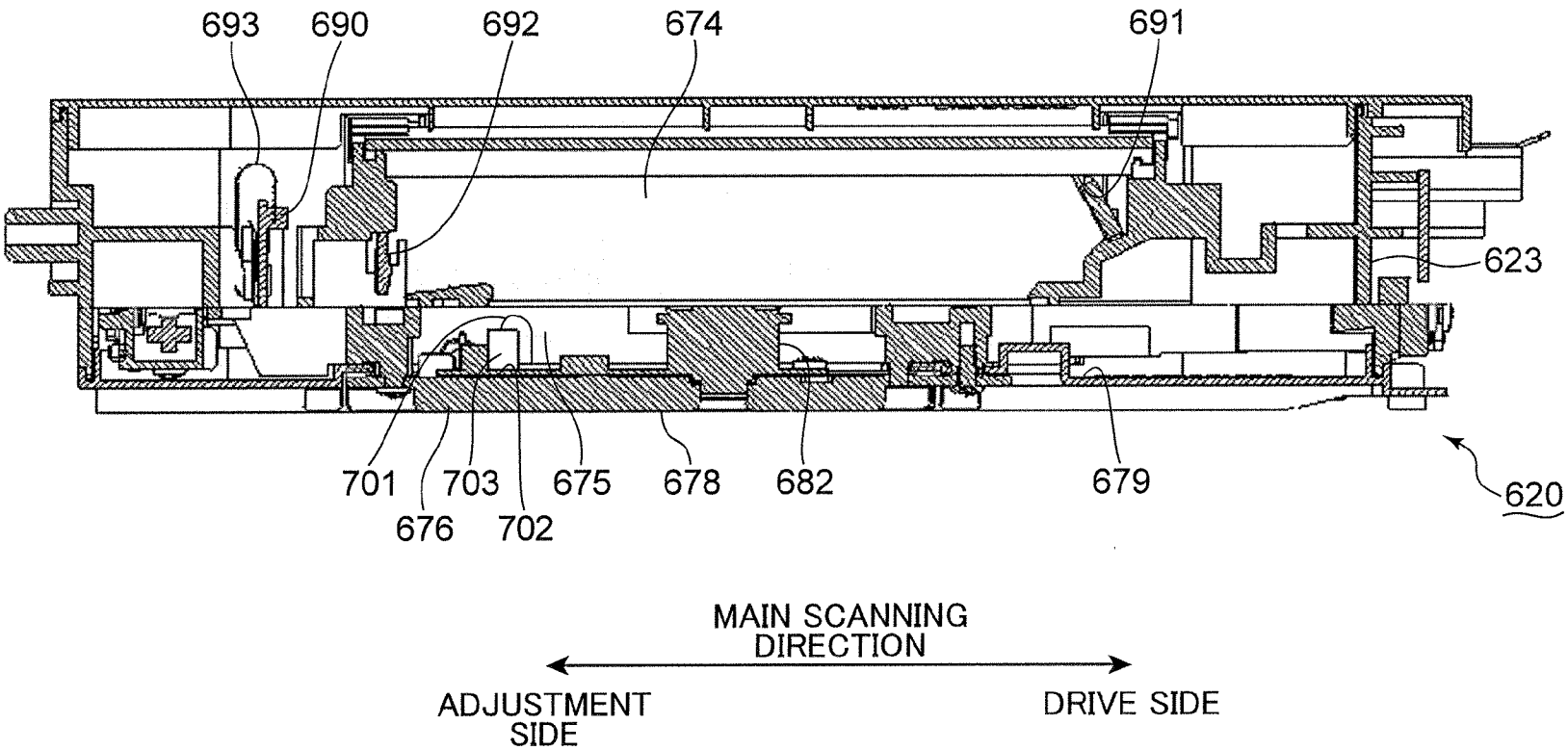
FIG. 8 is a sectional view along A-A of FIG. 7.

FIG. 8 is a sectional view of the housing 620 along an A-A line parallel to the main scanning direction shown in FIG. 7. An optical path of a laser beam to the sensor 690 is described with reference to FIGS. 1, 6 to 8.

The sensor 690 in the first space 674 is arranged near the first wall 622. A detection mirror 691 configured to reflect a laser beam toward the sensor 690 is arranged closer to the drive side (i.e. closer to the second wall 623) than the sensor 690. As described in the context of FIG. 6, a laser beam group composed of several laser beams reaches the second mirror 685 after the reflection by the first mirror 684. The laser beam group on the way from the first mirror 684 to the second mirror 685 is partially reflected by the detection mirror 691 arranged adjacent to the second mirror 685.

A lens 692 is arranged at an intermediate position of an optical path of the laser beam propagating from the detection mirror 691 toward the sensor 690. The lens 692 adjusts a focal point of the laser beam on the sensor 690. Thus, the sensor 690 may properly detect the laser beam in the first space 674.

The sensor 690 outputs a signal indicating the detection or non-detection of the laser beam. A signal line 693 configured to transmit the output signal of the sensor 690 to a controller (not shown) responsible for a control of the entire image forming apparatus 1 extends from the sensor 690.

Figure 9:
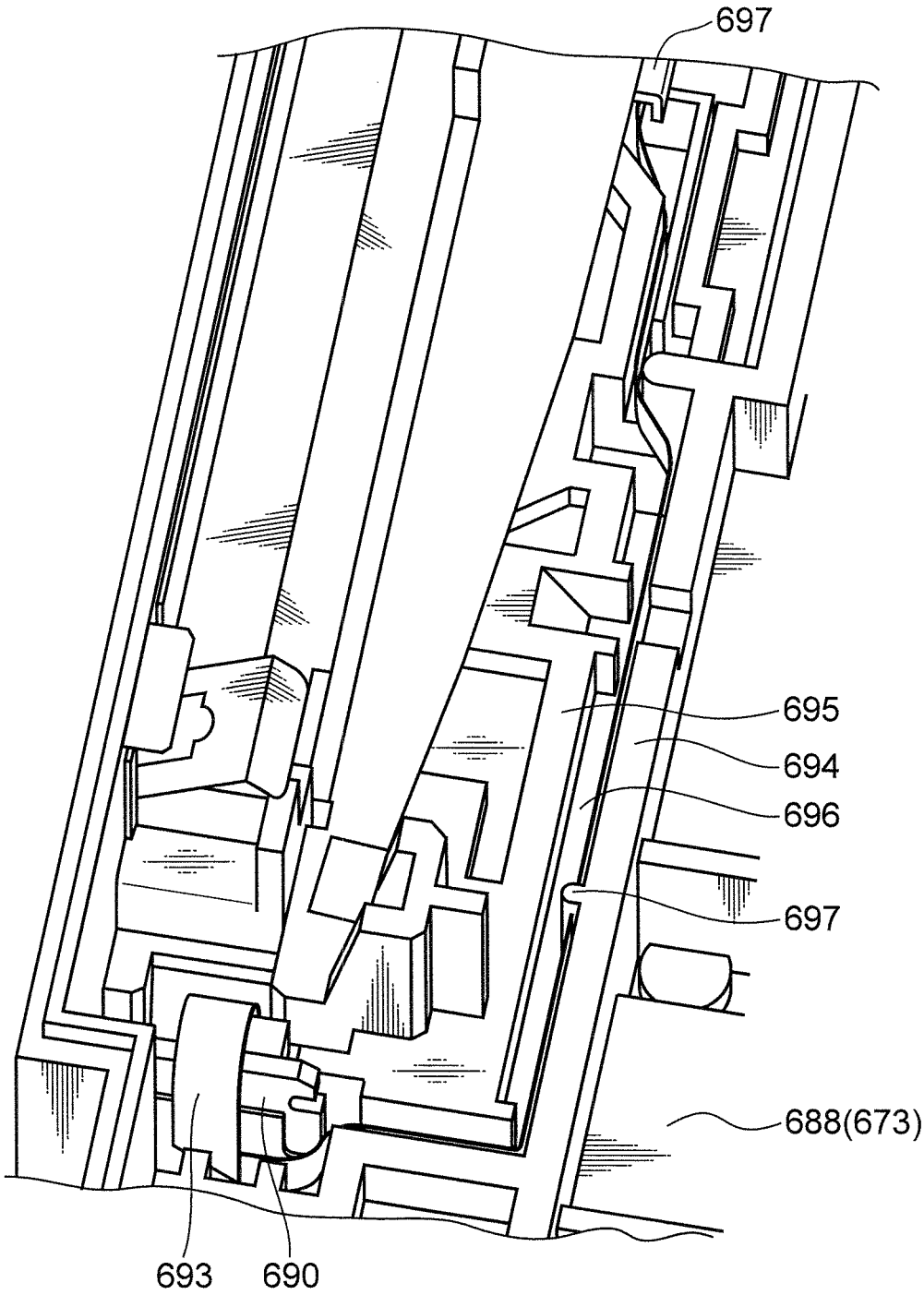
FIG. 9 is a perspective view of the interior of the housing to show an arrangement path of a signal line extending from the sensor shown in FIG. 7.

FIG. 9 is a perspective view showing an arrangement path of the signal line 693 extending from the sensor 690. The arrangement of the signal line 693 is described with reference to FIGS. 6, 8 and 9.

The signal line 693 extending from the sensor 690 is arranged along a groove 696 formed between paired guide walls 694, 695 projecting upward from the third surface 688 of the partition 673. The guide walls 694, 695 are exemplified as a nip portion configured to nip the signal line 693. The groove 696 is at least partially used as the arrangement path of the signal line 693. The guide walls 694, 695 preferably include retaining portions 697 configured to restrict upward displacement of the signal line 693. The retaining portions 697 projecting from inner surfaces facing the groove 696 may be projections each formed with a slit, through which the signal line 693 is inserted. Alternatively, the retaining portions 697 may be projections projecting from the inner surfaces facing the groove 696 along an upper edge of the signal line 693 and partially closing an upper opening of the groove 696. Further alternatively, leaf springs pressed into contact with the inner surfaces facing the groove 696 may be used as the retaining portions 697. The leaf springs arranged in the groove 696 may sandwich the signal line 693 in cooperation with the guide walls 694, 695. Thus, the signal line 693 extending in the first space 674 is arranged at a position sufficiently far from a power line 701 configured to supply power to the motor 682 in the second space 675.

Referring back to FIG. 8, there is described an arrangement of the power line 701 configured to supply power to the motor 682.

A substrate 702 formed with a circuit configured to operate the motor 682 is mounted on the second surface 679 of the supporting plate 676. A connector 703 is mounted on the substrate 702. The connector 703 electrically connects the power line 701 to the motor 682 via the circuit on the substrate 702. The power line 701 extending from the connector 703 further extends to the outside of the housing 620 via a through hole 704 formed in the supporting plate 676.

Figure 10:
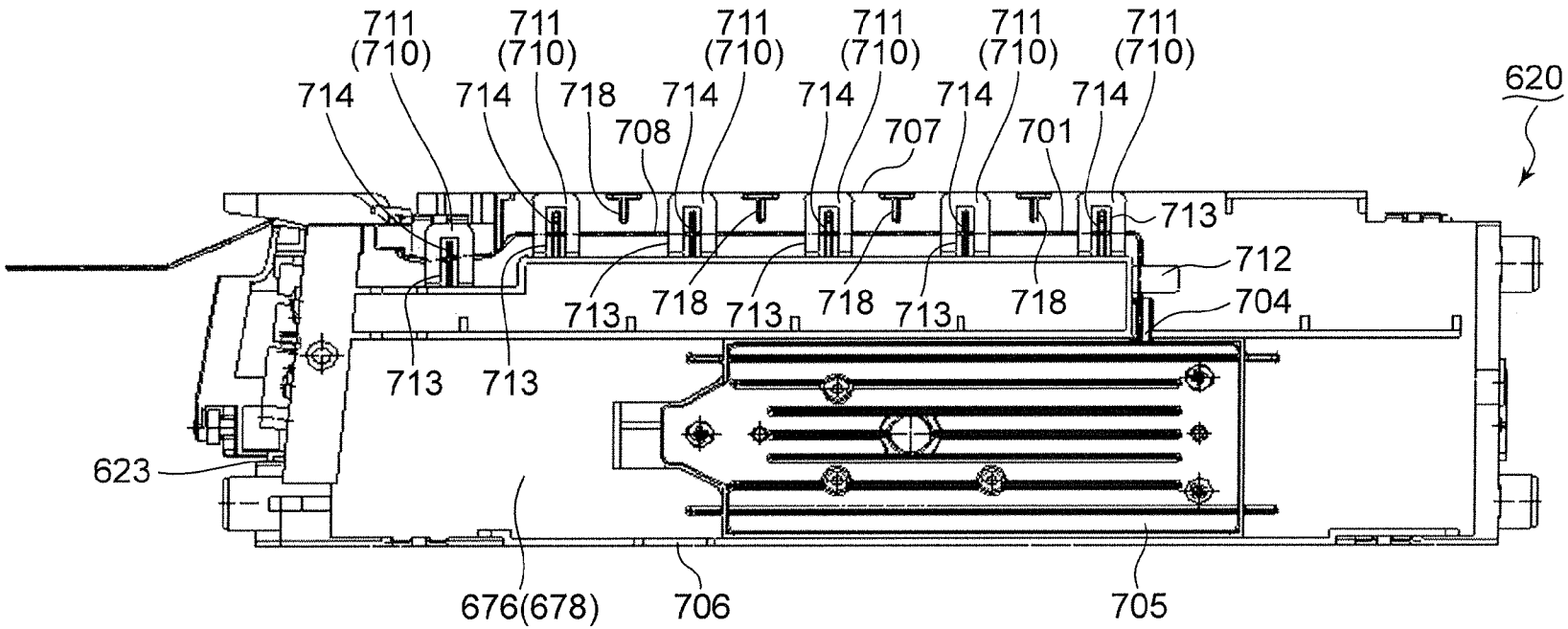
FIG. 10 is a bottom view of the exposure device shown in FIG. 4.

FIG. 10 is a bottom view of the housing 620. The arrangement of the power line 701 is further described with reference to FIGS. 8 and 10.

The power line 701 extending to the outside of the housing 620 through the through hole 704 formed in the supporting plate 676 is drawn out toward an edge 707 opposite to an edge 706 of the supporting plate 676 at a side where a heat sink 705 configured to radiate heat of the motor 682 is arranged. Thereafter, the power line 701 is drawn toward the second wall 623 substantially in parallel with the edge 707.

The supporting plate 676 includes a rib 708 projecting downward from the first surface 678. The rib 708 extends along the arrangement path of the power line 701. Arms 711 of substantially U-shaped holding portions 710 extend toward the edge 707 from a part of the rib 708 substantially parallel to the edge 707. The holding portions 710 hold the power line 701 drawn out from the housing 620. As a result, the power line 701 is arranged along the first surface 678 of the supporting plate 676.

Figure 11A:
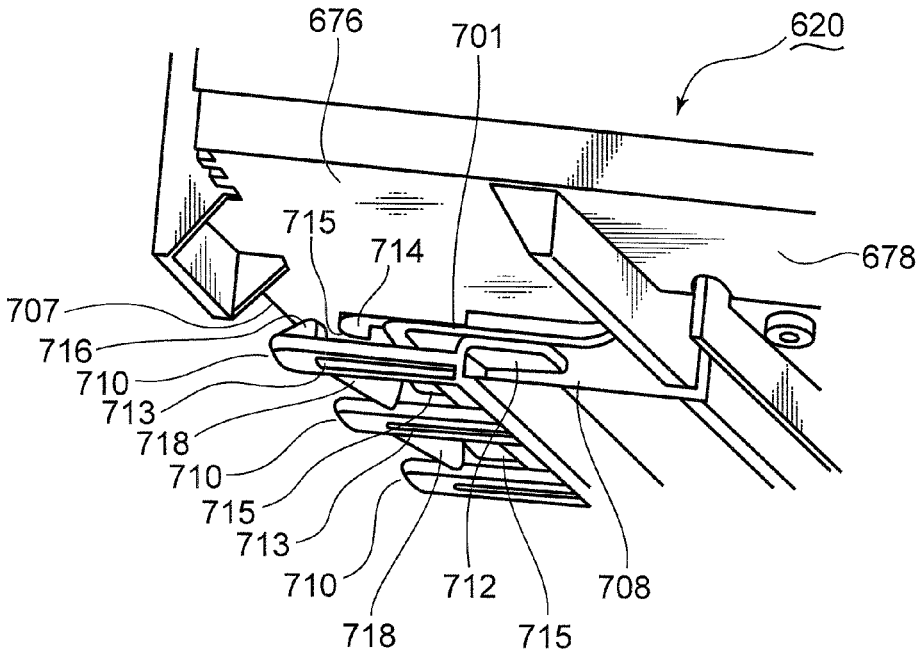
FIG. 11A is a perspective view of the housing around holding portions.
Figure 11B:
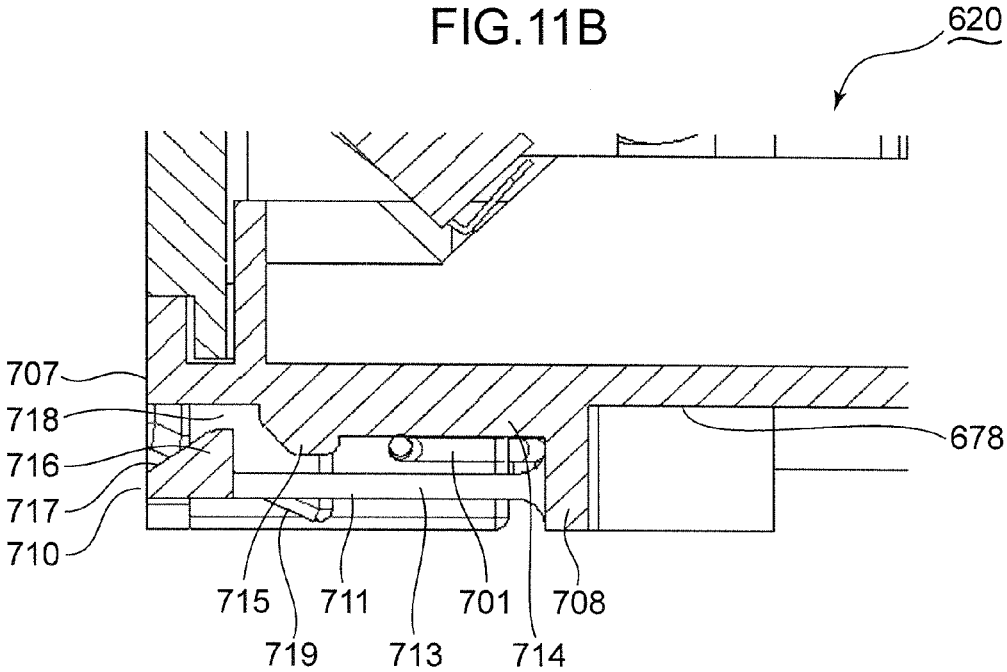
FIG. 11B is a sectional view of the housing around the holding portions.

FIGS. 11A and 11B are enlarged views around the holding portions 710. FIG. 11A is a perspective view of the housing 620 around the holding portions 710. FIG. 11B is a sectional view of the housing 620 around the holding portions 710. The holding portions 710 are described with reference to FIGS. 10 to 11B.

A projecting plate 712 extends from an outer surface part of the rib 708, which extends toward the edge 707. The projecting plate 712 supports the power line 701 extending toward the edge 707. The power line 701 is then bent in a direction along the edge 707.

Several holding portions 710 extend toward the edge 707 from the part of the rib 708 extending substantially parallel to the edge 707. FIG. 10 shows six holding portions 710. Alternatively, five or less holding portions 710 may be formed or seven or more holding portions 710 may be formed.

Each holding portion 710 includes the substantially U-shaped arm 711 extending along the first surface 678. The arms 710 made of resin are formed integrally to the supporting plate 676. The arms 711 form openings 713 together with the rib 708. Because of the formation of the openings 713, a support width for the power line 701 by the arms 711 increases while the flexibility of the arms 711 is enhanced.

The supporting plate 676 includes pressing ribs 714 projecting downward from the first surface 678. The pressing ribs 714 extend from the rib 708 toward the edge 707. Each pressing rib 714 includes a retaining portion 715. The retaining portion 715 projects toward the opening 713 from a tip of the pressing rib 714.

Each arm 711 includes a substantially triangular hook 716. The hook 716 projects from a tip of the arm 711 toward the first surface 678. The power line 701 extends in a clearance between the pressing ribs 714 and the arms 711. The retaining portions 15 are formed at positions closer to the power line 701 than the hooks 716. Further, lower ends of the retaining portions 715 are located below upper ends of the hooks 716. Since the retaining portions 715 and the hooks 716 horizontally overlaps each other, so that it is less likely that the power line 701 is detached from the holding portions 710.

Each hook 716 includes an inclined surface 717 (see FIG. 11B) which tapers the hook to its tip. When the user brings the power line 701 into contact with the inclined surfaces 717 and presses the power line 701 toward the base ends of the arms 711, the arms 711 are deformed downwardly. As a result, the user may easily allow the holding portions 710 to hold the power line 701.

The supporting plate 676 further includes stopper pieces 718. Each stopper piece 718 is substantially T-shaped when viewed from below (see FIG. 10) and substantially trapezoidal when viewed sideways (see FIG. 11B). As shown in FIG. 10, the stopper pieces 718 are aligned along the edge 707. Further, the stopper pieces 718 project downward from the first surface 678 between adjacent holding portions 710. Each stopper piece 718 includes an inclined edge 719. The inclined edge 719 increases a projecting amount of the stopper piece 718 toward the base end of the arm 711. Accordingly, the inclined surface 717 of the hook 716 and the inclined edge 719 of the stopper piece 718 look as if they would cross each other when viewed sideways. As described above, when the user brings the power line 701 into contact with the inclined surfaces 717 and presses the power line 701 toward the base ends of the arms 711, the inclined edges 719 of the stopper pieces 718 try to push down the power line 701. Thus, the arms 711 are urged to be curved downwardly. Further, the stopper pieces 718 project beyond lower surfaces of the arms 711. Thus, the stopper pieces 718 may suitably suppress detachment of the power line 701 from the holding portions 710.

The power line 701 held along the supporting plate 676 as described above is then apart from the housing 620 and connected to a predetermined power port (not shown) configured to supply power to drive sources of the image forming apparatus 1, respectively.

According to the aforementioned configuration, the optical unit configured to form an optical path of a laser beam is accommodated in the housing. The internal space of the housing is partitioned into the first and second spaces by the partition. The optical unit includes the mirror configured to determine a direction of the optical path and the drive source configured to operate the mirror to adjust the direction of the optical path. The mirror, the drive source and the power line configured to supply power to the drive source are arranged in the second space. The optical unit further includes the sensor configured to detect the laser beam in the first space and the signal line configured to transmit an output signal of the sensor. The signal line extends in the first space. Accordingly, the signal line is properly separated from the power line by the partition, which results in less noise to the output signal of the sensor. Further, since the power line and the signal line are arranged in two separate spaces, the power line and the signal line are individually arranged in the two spaces, respectively, which results in less trouble such as interception of the laser beam.

This application is based on Japanese Patent application serial No. 2010-063599 filed in Japan Patent Office on Mar. 19, 2010, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. An optical device for irradiating a laser beam, comprising:

an optical unit configured to form an optical path of the laser beam; and a housing including a container defining an internal space for accommodating the optical unit and a partition configured to divide the internal space surrounded by the container into a first space and a second space below the first space, wherein the optical unit includes:

a sensor arranged in the first space to detect the laser beam, a mirror arranged in the second space to determine a direction of the optical path, a drive source arranged in the second space to rotate the mirror about an axis orthogonal to the partition and to adjust the direction of the optical path, a power line extending in the second space to supply power to the drive source, and a signal line extending in the first space to transmit an output signal of the sensor.

2. The optical device according to claim 1, further comprising:

a supporting plate configured to form an outer surface of the housing, wherein:

the supporting plate is formed with a through hole, through which the power line extends from the drive source to outside of the housing, the supporting plate including a holding portion configured to hold the power line extending to the outside of the housing.

3. The optical device according to claim 2, wherein:

the supporting plate includes a first surface forming the outer surface of the housing;

the holding portion includes a rib extending down from the first surface, an arm extending horizontally from a lower end of the rib along the first surface and a hook projecting up from the arm toward the first surface; and the power line is arranged between the first surface and the arm.

4. The optical device according to claim 3, further comprising:

a substrate including a connector configured to electrically connect the power line to the drive source, wherein:

the supporting plate includes a second surface opposite to the first surface; and the substrate is mounted on the second surface.

5. The optical device according to claim 3, wherein:

the supporting plate includes a stopper piece beside the holding portion, the stopper piece protrudes down from the first surface toward the arm at a location between the stopper piece and the hook and includes an inclined edge that is inclined down toward a base end of the arm so that a projecting amount of the stopper piece increases toward a base end of the arm, and the hook includes an inclined edge that is inclined up toward the base end of the arm.

6. The optical device of claim 5, wherein a distance between the stopper piece and the arm is no greater than a projecting distance of the hook toward the first surface.

7. The optical device according to claim 1, wherein:

the partition includes a third surface defining the first space and two guide walls projecting up from the third surface so as to guide the signal line, and the guide walls sandwich the signal line.

8. An image forming apparatus for forming a toner image, comprising:

an image bearing member including a surface configured to bear the toner image; and an optical device configured to irradiate a laser beam to the surface of the image bearing member, the optical device including an optical unit configured to form an optical path of the laser beam, and a housing including a container that defines an internal space for accommodating the optical unit, wherein the housing includes a partition configured to divide the internal space surrounded by the container into a first space and a second space below the first space; and the optical unit includes:

(i) a sensor arranged in the first space to detect the laser beam, (ii) a mirror arranged in the second space to determine a direction of the optical path, (iii) a drive source arranged in the second space to rotate the mirror about an axis orthogonal to the partition and to adjust the direction of the optical path, (iv) a power line extending in the second space to supply power to the drive source, and (v) a signal line extending in the first space to transmit an output signal of the sensor.

* * * * *